US010570657B2

(12) United States Patent
Boyden

(10) Patent No.: US 10,570,657 B2
(45) Date of Patent: Feb. 25, 2020

(54) DOUBLE-GLAZED WINDOW OR DOOR ASSEMBLY

(71) Applicant: Michael John Boyden, New South Wales (AU)

(72) Inventor: Michael John Boyden, New South Wales (AU)

(73) Assignee: Michael John Boyden, New South Wales (AU)

( * ) Notice: Subject to any disclaimer, the term of this patent is extended or adjusted under 35 U.S.C. 154(b) by 0 days.

(21) Appl. No.: 15/836,071

(22) Filed: Dec. 8, 2017

(65) Prior Publication Data

US 2018/0100347 A1 Apr. 12, 2018

Related U.S. Application Data

(63) Continuation of application No. 15/272,823, filed on Sep. 22, 2016, now abandoned, which is a (Continued)

(30) Foreign Application Priority Data

May 27, 2013 (AU) ..... 2013901877

(51) Int. Cl.
*E06B 3/677* (2006.01)
*E06B 3/66* (2006.01)
(Continued)

(52) U.S. Cl.
CPC ..... *E06B 3/677* (2013.01); *E06B 3/66* (2013.01); *E06B 3/663* (2013.01); *E06B 7/02* (2013.01); *E06B 7/14* (2013.01); *E06B 2007/026* (2013.01)

(58) Field of Classification Search
CPC ... E06B 7/02; E06B 3/677; E06B 3/66; E06B 7/14; E06B 2007/026
(Continued)

(56) References Cited

U.S. PATENT DOCUMENTS 1,474,160 A * 11/1923 Nugent ..... F16K 15/20 251/322
2,125,372 A * 8/1938 Fox ..... C03B 23/245 220/304
(Continued)

FOREIGN PATENT DOCUMENTS

CN 101328779 A 12/2008
CN 201202375 Y 3/2009
(Continued)

OTHER PUBLICATIONS

International Search Report dated Jul. 28, 2014 for PCT Application No. PCT/AU2014/000556.
(Continued)

*Primary Examiner* — Joshua K Ihezie
(74) *Attorney, Agent, or Firm* — Moser Taboada

(57) ABSTRACT

A double-glazed window or door assembly is provided. The double-glazed window or door assembly comprises a first glass pane and a second glass pane spaced apart to form a volume therebetween. A perimeter seal is located between adjacent faces of the first glass pane and the second glass pane to substantially seal said volume. A one-way inlet valve is mounted on the second glass pane to provide fluid communication from atmosphere to the sealed volume. A one-way outlet valve is mounted on the second glass pane to provide fluid communication from the sealed volume to atmosphere.

13 Claims, 4 Drawing Sheets

Related U.S. Application Data continuation of application No. 14/892,488, filed as application No. PCT/AU2014/000556 on May 27, 2014, now abandoned.

(51) Int. Cl.
*E06B 7/02* (2006.01)
*E06B 7/14* (2006.01)
*E06B 3/663* (2006.01)

(58) Field of Classification Search
USPC .... 251/333, 278, 264, 337; 52/171.3, 302.7, 52/172, 204.52
See application file for complete search history.

(56) References Cited

U.S. PATENT DOCUMENTS 2,359,163 A * 9/1944 Sherts ..... B32B 17/10036 156/99
2,795,018 A * 6/1957 Shaw ..... C03B 23/245 52/204.52
2,805,452 A * 9/1957 Englehart ..... C03B 23/245 29/458
2,880,475 A * 4/1959 Mills ..... E06B 3/66347 29/511
2,886,864 A * 5/1959 Boicey ..... C03B 23/245 52/204.52
2,887,737 A * 5/1959 Prescott ..... C03B 23/245 220/2.2
4,155,205 A * 5/1979 Polman ..... E06B 7/12 52/171.3
4,567,703 A * 2/1986 Ricks ..... E06B 3/677 52/171.3
4,587,784 A * 5/1986 Chavy ..... E06B 3/677 52/204.52
6,105,595 A * 8/2000 Jensen ..... B23Q 1/0036 137/15.12
6,397,662 B1 * 6/2002 Alkhoury ..... E06B 3/5409 73/31.04
6,553,728 B1 * 4/2003 Zurn ..... E06B 3/677 251/215
8,099,916 B2 * 1/2012 Joasil ..... E06B 7/02 454/122
8,112,860 B2 * 2/2012 Collins ..... E06B 3/677 29/402.01
2003/0003252 A1 * 1/2003 Yun ..... B29C 44/18 428/36.9
2007/0033887 A1 * 2/2007 Ambrose ..... E06B 3/677 52/171.3
2009/0110866 A1 * 4/2009 Ainz ..... B32B 17/10055 428/53
2010/0071805 A1 * 3/2010 Mackey ..... B60K 15/04 141/113
2015/0068666 A1 * 3/2015 Abe ..... C03C 27/06 156/109
2017/0328121 A1 * 11/2017 Purdy ..... E06B 9/24

FOREIGN PATENT DOCUMENTS

EP 0237585 A1 9/1987
JP S5948584 A 3/1984
WO WO-0246562 A1 6/2002

OTHER PUBLICATIONS

Extended European Search Report dated Dec. 19, 2016 for Application No. 14803858.1.

* cited by examiner

DOUBLE-GLAZED WINDOW OR DOOR ASSEMBLY

CROSS-REFERENCE TO RELATED APPLICATIONS

This application is a continuation of U.S. patent application Ser. No. 15/272,823, filed on Sep. 22, 2016, which claims the benefit of U.S. application Ser. No. 14/892,488, filed on Nov. 19, 2015, which is a national phase application of the PCT Application No. PCT/AU2014/000556, filed on May 27, 2014, which claims priority to the Australian Patent Application No. 2013901877, filed on May 27, 2013. The disclosure of each of the applications above is incorporated herein by reference in its entirety.

BACKGROUND

Field of the Invention

The present invention relates to double-glazed windows or doors and more particularly to a double-glazed window or door assembly as well as a related method.

Description of the Related Art

Double-glazed windows or doors are known and generally comprise two spaced apart glass panes with a sealed gaseous volume there between. The gaseous volume functions as an insulator.

Conventional double-glazed windows or doors are usually constructed, transported and installed as a single unit including the window, window sill and frame seals. The (moist) air between the glass panes is removed during assembly and the volume between the glass panes is then sealed. A disadvantage is that there is no means to control the gaseous environment within the sealed volume once the double-glazed window or door is assembled. A further disadvantage is that the seals of a double-glazed window or door can be compromised with the passage of time, resulting in a reduction of insulating properties.

OBJECT OF THE INVENTION

It is an object of the present invention to substantially overcome or at least ameliorate one or more of the above disadvantages.

SUMMARY

A first aspect of the present invention provides a double-glazed window or door assembly comprising:

a first glass pane and a second glass pane spaced apart to form a volume therebetween;

a perimeter seal between adjacent faces of the first glass pane and the second glass pane to substantially seal said volume;

a one-way inlet valve mounted on the second glass pane to provide fluid communication from atmosphere to the sealed volume; and a one-way outlet valve mounted on the second glass pane to provide fluid communication from the sealed volume to the atmosphere.

Preferably, the one-way inlet valve and the one-way outlet valve are biased closed.

Preferably, the one-way inlet valve includes a valve member moveable longitudinally between a closed position, preventing fluid communication from atmosphere to the sealed volume, and an open position, allowing fluid communication from atmosphere to the sealed volume.

Preferably, the one-way outlet valve includes a valve member moveable longitudinally between a closed position, preventing fluid communication from the sealed volume to atmosphere, and an open position, allowing fluid communication from the sealed volume to atmosphere.

Preferably, the one-way inlet valve and the one-way outlet valve each further include a support ring to restrict lateral movement of the respective valve member, the support ring having at least one hole to facilitate fluid communication between the sealed volume and atmosphere.

Preferably, the one-way inlet valve and the one-way outlet valve each further include a spring mounted on the valve member to bias the respective valve member to the closed position.

Preferably, the one-way inlet valve further includes a body having a mounting portion and a neck portion, the body further including a bore, with a longitudinal axis that extends through the mounting and neck portions, providing a passage between the sealed volume and atmosphere.

Preferably, the one-way inlet valve further includes an insert mounted in the bore to substantially seal the passage to prevent fluid communication therethrough, the insert is made from a material that allows a needle to penetrate therethrough and resiliently seals the passage when the needle is withdrawn.

Preferably, the insert is made from rubberized silicon or other equivalent material.

Preferably, the bore of the one-way inlet valve further includes an internal thread located in the mounting portion, the internal thread provides for the connection of an external hose for introduction of a gaseous material.

Preferably, the one-way outlet valve further includes a body having a mounting portion and a neck portion, the body further including a bore, with a longitudinal axis that extends through the mounting and neck portions, providing a passage between the sealed volume and atmosphere.

Preferably, the one-way outlet valve further includes a screw top mounted on the mounting portion of the one-way outlet valve, the screw top having at least one hole to enable fluid communication from the sealed volume to atmosphere, wherein turning of the screw top in a first direction moves the valve member from the closed position to the open position, and turning of the screw top in an opposite direction to the first direction enables the valve member to move from the open position to the closed position. Preferably, the screw top further includes an internal threaded section to provide for the connection of an external hose through which contents of the sealed volume is collected.

Preferably, the one-way inlet valve and the one-way outlet valve are made from brass, stainless steel or other ultraviolet light stable materials.

A second aspect of the present invention provides a method of controlling a gaseous environment of a sealed volume between two spaced apart glass panes of a double-glazed window or door assembly, the method comprising the steps of:

mounting a one-way inlet valve and a one-way outlet valve onto one of the glass panes;

removing contents of the sealed volume via the outlet valve; and introducing a gaseous material into the sealed volume via the inlet valve.

Preferably, the step of mounting the one-way inlet valve and the one-way outlet valve includes drilling two holes into one of the glass panes; and inserting the one-way inlet valve and the one-way outlet valve into one of each of the two holes respectively.

BRIEF DESCRIPTION OF THE DRAWINGS

Preferred embodiments of the invention will be described hereinafter, by way of examples only, with reference to the accompanying drawings, in which.

DETAILED DESCRIPTION

Figure 1:
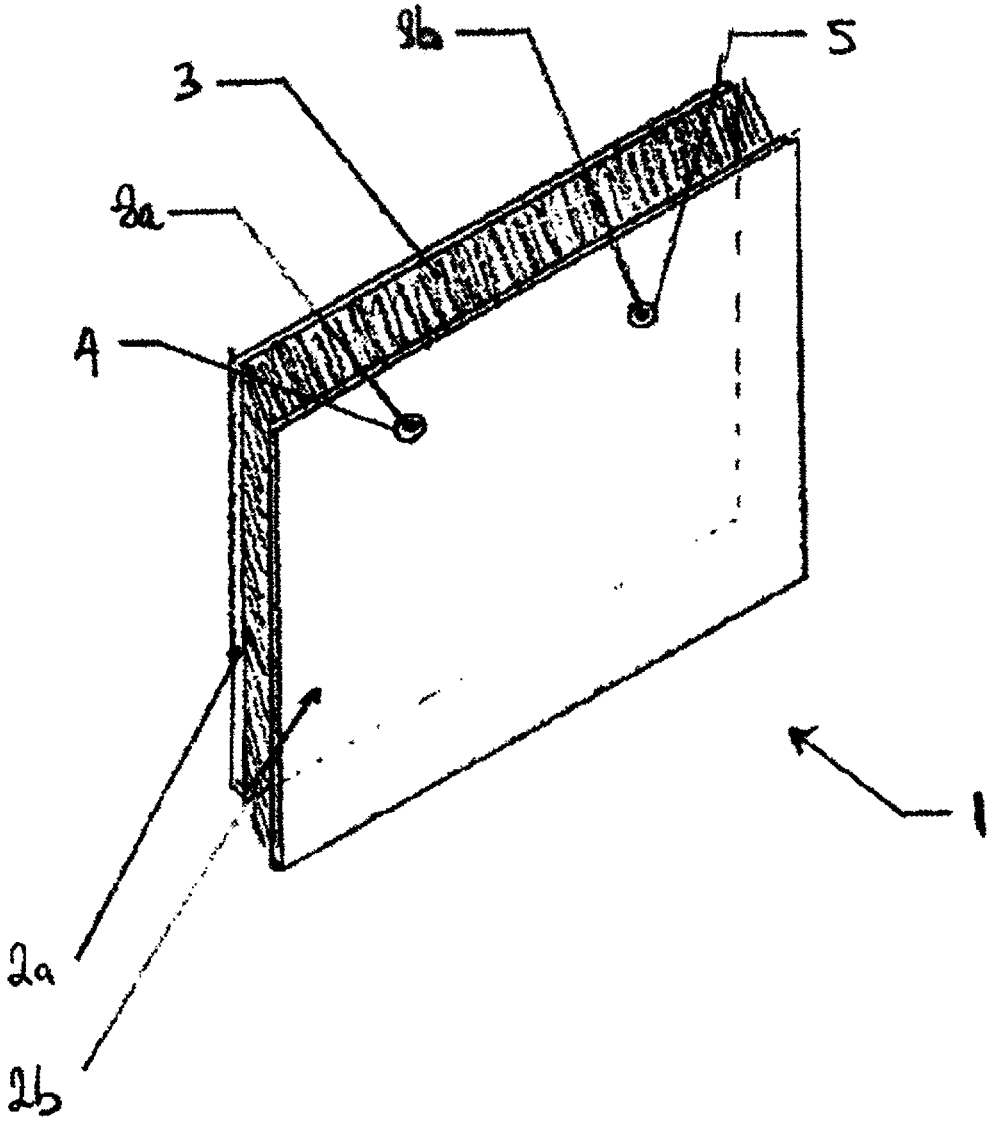
FIG. 1 is a perspective view of an embodiment of a double-glazed window or door assembly.

FIG. 1 shows an embodiment of a double-glazed window or door assembly 1. The assembly 1 includes two glass panes 2*a*, 2*b* which are spaced apart to form a volume therebetween. The assembly 1 further includes a perimeter seal 3 between adjacent faces of the glass panes 2*a*, 2*b* to substantially seal the volume. The glass pane 2*b* includes a first (pre-drilled) hole 8*a* and a second (pre-drilled) hole 8*b* located at the upper most portion of the glass pane 2*b*. A one-way inlet valve 4 is mounted in the first hole 8*a*. A one-way outlet valve 5 is mounted in the second hole 8*b*. The inlet and outlet valves 4, 5 are made from brass, stainless steel or other ultra-violet light stable materials.

Figure 2:
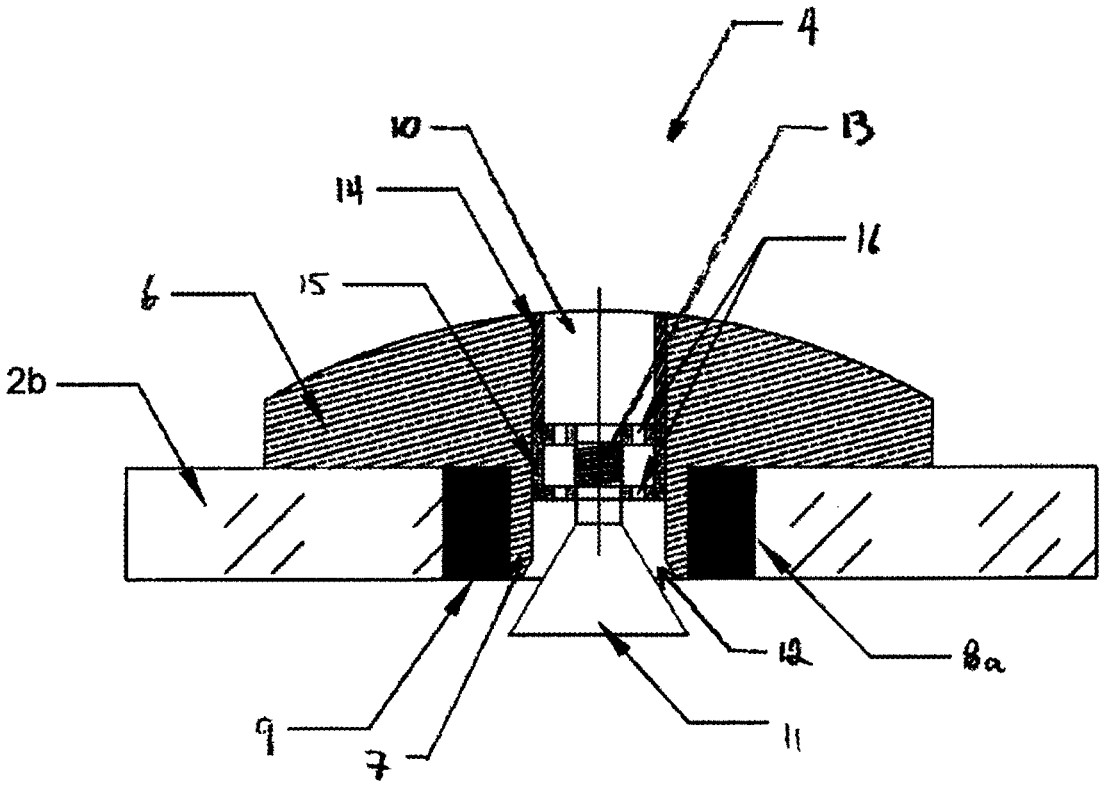
FIG. 2 is cross-sectional side view of an embodiment of an inlet valve mounted on a double-glazed window or door assembly.

As best shown in FIG. 2, the inlet valve 4 of the double-glazed window assembly 1 includes a mounting portion 6 and a neck portion 7. The mounting portion 6 is adhered to the glass pane 2*b* with a flexible sealant to form a strong air-tight seal to the glass pane 2*b*. The neck portion 7 is inserted into the first hole 8*a* in the glass pane 2*b*. A flexible seal 9 is mounted between the neck portion 4 and the first hole 8*a* to form a substantially air-tight seal therebetween.

The inlet valve 4 also includes a bore 10 having a longitudinal axis and extending through the mounting portion 6 and the neck portion 7. A valve member 11, having a conical head, is provided in the bore 10. The valve member 11 is movable longitudinally between a closed position and an open position. In the closed position, the conical head is aligned with the opening 12 in the neck portion 7 to form a substantial seal and prevent fluid communication from atmosphere to the sealed volume. In the open position, the valve member 11 is displaced relative to the opening 12 to provide fluid communication from atmosphere to the sealed volume. A spring 13 is mounted on the valve member 11 to bias the valve member 11 to the closed position. The valve member 11 is supported by a support ring 15. The support ring 15 has two holes 16 to facilitate gas charging.

The bore 10 also comprises an internal thread 14 located on the mounting portion 6 of the inlet valve 4. The internal thread 14 provides for the connection of an external hose through which a pressurized gas from an external gas supply can be introduced into the sealed volume. For example, the external gas supply can be a pressure pack can supplying carbon dioxide.

Figure 3:
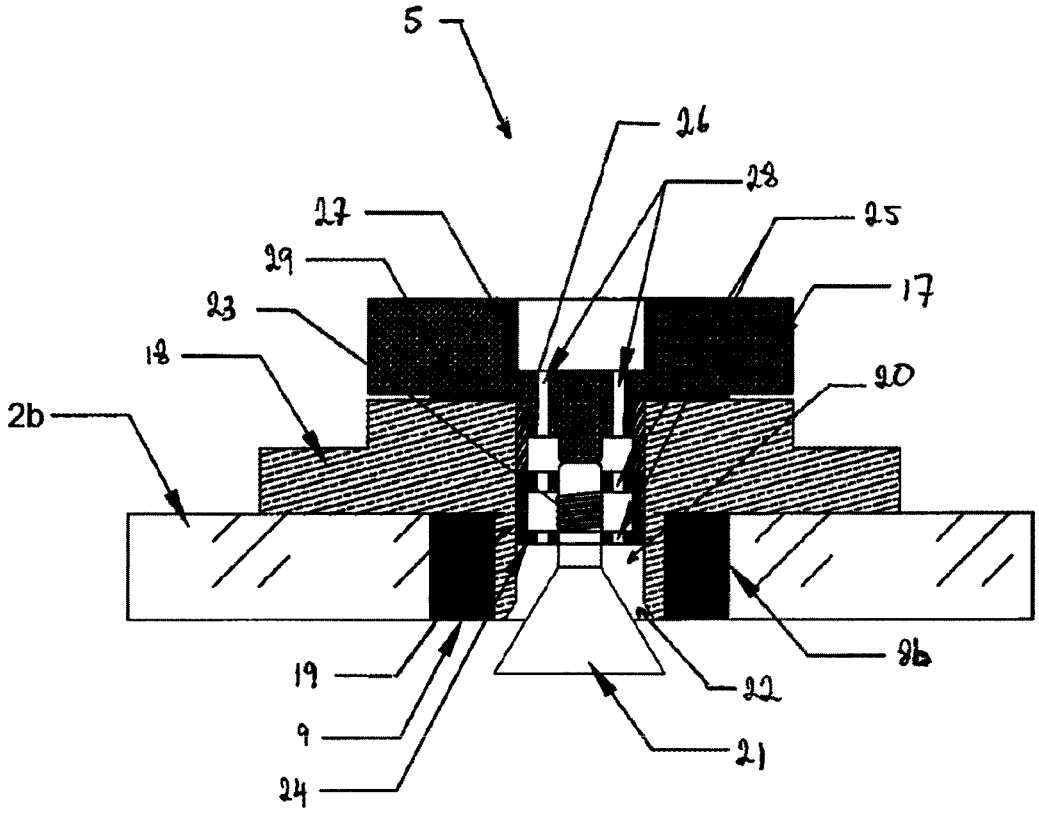
FIG. 3 is a cross-sectional side view of an embodiment of an outlet valve mounted on a double-glazed window or door assembly.

As best shown in FIG. 3, the outlet valve 5 includes a mounting portion 18 and a neck portion 19. The mounting portion 18 is adhered to the glass pane 2*b* with a flexible sealant to form a strong air-tight seal to the glass pane 2*b*. The neck portion 19 is inserted into the second hole 8*b* in the glass pane 2*b*. A flexible seal 9 is mounted between the neck portion 19 and the second hole 8*b* to form a substantially air-tight seal therebetween.

The outlet valve 5 also includes a bore 20 having a longitudinal axis and extending through the mounting portion 18 and the neck portion 19. A valve member 21 having a conical head is provided in the bore 20. The valve member 21 is movable longitudinally between a closed position and an open position. In the closed position, the conical head is aligned with the opening 22 in the neck portion 19 to form a substantial seal and prevent fluid communication from the sealed volume to atmosphere. In the open position, the valve member 21 is displaced relative to the opening 22 to provide fluid communication from the sealed volume to atmosphere. A spring 23 is mounted on the valve member 21 to bias the valve member 21 to the closed position. The valve member 21 is supported by a support ring 24. The support ring 24 has four holes 25 to facilitate gas release.

The bore 20 also comprises an internal thread 26 located on the mounting portion 18 of the outlet valve 5. The internal thread 26 provides for the connection of a screw top 17. The screw top 17 having an internal threaded section 27 for connection of an external collection hose. The screw top 17 further comprises two holes 28 to provide for fluid communication from the sealed volume to atmosphere via the bore 20. A seal 29 is mounted between adjacent sides of the mounting portion 18 and the screw top 17 to provide a substantially air-tight seal therebetween.

The use of the assembly 1 in replacing the gaseous contents of the volume will now be described. Firstly, the screw top 17 of the outlet valve 5 is turned, which forces the valve member 21 to move from the closed position to the open position. In the open position, gas can flow out of the sealed volume through the outlet valve 5. The inlet valve 4 is then charged with the supply of new gas, by connecting the external hose to the internal thread 14 of the inlet valve 4 to the gas supply (pressure pack). The new gas passes through the holes 16 of the support ring 15 towards the opening 12 in the neck portion 7. Pressure from the new gas displaces the valve member 11 of the inlet valve 4 from the closed position to the open position, allowing the new gas to pass into the sealed volume. The new gas (typically being carbon dioxide and heavier than air) forces the existing gas to pass through the holes 25 of the support ring 24 of the outlet valve 5, and then through the holes 28 of the screw top 17. An external collection hose is connected to the screw top 17, via the internal threaded section 27, to collect the expelled gases. When the existing gas is fully replaced with new gas, the supply of new gas is stopped and the outlet valve 5 is simultaneously closed. Once the supply of new gas is stopped, the spring 13 of the valve member 11 closes the inlet valve 4. The outlet valve 5 is simultaneously sealed by turning the screw top 17 in the opposite direction. The spring 23 then becomes the dominant force on the valve member 21, closing the outlet valve 5.

Figure 4:
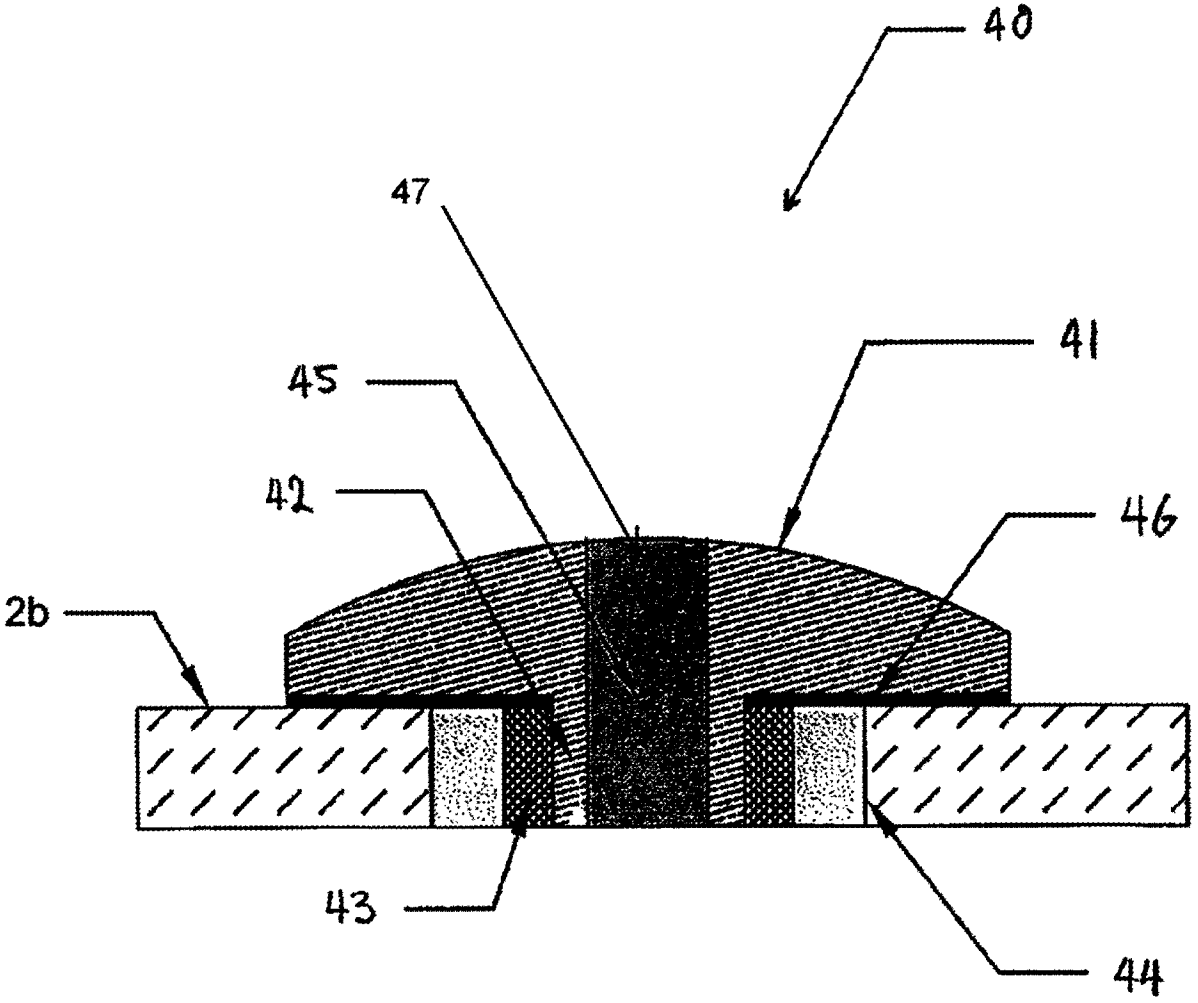
FIG. 4 is a cross-sectional side view of an alternative embodiment of an inlet valve mounted on a double-glazed window or door assembly.

FIG. 4 shows an alternative embodiment of an inlet valve 40 of the double-glazed window assembly 1. The inlet valve 40 includes a mounting portion 41 and a neck portion 42. The mounting portion 41 is connected to the glass pane 2*b* via a threaded insert 43. The threaded insert 43 is adhered to the first hole 8*a* with an epoxy 44 or other equivalent adhesives to form a strong air-tight seal to the glass pane 2*b*.

A rubberized gasket seal 46 is mounted between the glass pane 2*b* and the mounting portion 41 to form a substantially air-tight seal therebetween.

The inlet valve 40 also includes a bore 47 having a longitudinal axis and extending through the mounting portion 41 and the neck portion 42. An insert 45 is fixed within the bore 47 to form a substantial seal and prevent fluid communication from atmosphere to the sealed volume. The insert 45 is made from a rubberized silicon or other equivalent resilient material.

In use, a hollow needle (not shown) is used to penetrate the insert 45 to allow new gas to be charged through the inlet valve 40 via an external gas supply. When the needle is withdrawn from the insert 45, the insert 45 resiliently seals the bore 47 to prevent fluid communication therethrough.

The assembly described above has numerous advantages. Firstly, it allows for gaseous material to be exchanged from within the sealed volume of the double-glazed window or door. Secondly, a gaseous sealant can be introduced into the sealed volume to restore a compromised perimeter seal, and thus restores the insulative properties of the volume. Thirdly, the assembly allows moisture laden gas from within the sealed volume to be removed and replaced with dry air. Other gaseous materials such as a fire retardant can also be introduced into the sealed volume and released at the time of a fire situation. The valves also provide minimal penetration of the glass pane and can therefore be installed when the space between two glass panes is narrow.

Although the invention has been described with reference to a preferred embodiment, it will be appreciated by person skilled in the art that the invention may be embodied in many other forms.

The invention claimed is:

1. A method of providing a double-glazed window or door assembly, the method comprising:

providing, in spaced relation to a first glass pane affixed to a frame, a second glass pane including two spaced apart pre-drilled holes, wherein the second glass pane is spaced apart from the first glass pane to form a volume there-between;

sealing, using a perimeter seal, a perimeter between adjacent or opposing faces of the first glass pane and the second glass pane to substantially seal said volume between the first and second glass panes;

mounting a one-way inlet valve in a first of the two spaced apart pre-drilled holes on the second glass pane to provide fluid communication from the atmosphere to the sealed volume between the first and second glass panes;

mounting, in a second of the two spaced apart pre-drilled holes, a one-way outlet valve on the second glass pane to provide fluid communication from the sealed volume to the atmosphere; and introducing a substantially inert gas into the sealed volume between the first and second glass panes via the one-way inlet valve on the second glass pane to fill the sealed volume with the substantially inert gas while expelling air from the sealed volume via the one-way outlet valve on the second glass pane, wherein the step of introducing the gas into the sealed volume comprises opening the one-way inlet valve via gas pressure against a resilient bias of the one-way inlet valve, and wherein the step of expelling air from the sealed volume comprises opening the one-way outlet valve, wherein the step of opening the one-way outlet valve includes moving a valve member from a closed position, in which it prevents fluid communication from the sealed volume to the atmosphere, to an open position, in which it allows fluid communication from the sealed volume to the atmosphere, wherein the step of expelling air from the sealed volume via the one-way outlet valve further includes turning a portion of the one-way outlet valve in a first direction to move the valve member from the closed position to the open position, and wherein turning the portion in a direction opposite to the first direction enables the valve member to move from the open position to the closed position.

2. The method according to claim 1, whereby the step of opening the one-way inlet valve includes:

moving a valve member from a closed position, in which it prevents fluid communication from the atmosphere to the sealed volume, to an open position, in which it allows fluid communication from the atmosphere to the sealed volume.

3. The method according to claim 2, whereby the step of introducing the gas into the sealed volume comprises:

opening the one-way inlet valve by moving the valve member against a spring biasing the valve member to the closed position.

4. The method according to claim 1, whereby the step of introducing the gas into the sealed volume between the first and second glass panes via the one-way inlet valve comprises:

connecting an external gas supply to the one-way inlet valve.

5. The method according to claim 1, whereby the step of expelling air from the sealed volume via the one-way outlet valve further comprises:

collecting contents of the sealed volume.

6. The method according to claim 1, wherein the one-way inlet valve and the one-way outlet valve are made from brass, stainless steel or an ultra-violet light stable material.

7. A method of providing a double-glazed window or door assembly, the method comprising:

providing, in spaced relation to a first glass pane, a second glass pane including two spaced apart pre-drilled holes, wherein the second glass pane is spaced apart from the first glass pane to form a volume there-between;

sealing a perimeter between adjacent or opposing faces of the first glass pane and the second glass pane to substantially seal said volume between the first and second glass panes;

mounting a one-way inlet valve in a first of the two spaced apart pre-drilled holes on the second glass pane to provide fluid communication from the atmosphere to the sealed volume between the first and second glass panes;

mounting in a second of the two spaced apart pre-drilled holes a one-way outlet valve on the second glass pane to provide fluid communication from the sealed volume to the atmosphere;

introducing carbon dioxide gas into the sealed volume between the first and second glass panes via the one-way inlet valve on the second glass pane to fill the sealed volume with the carbon dioxide gas while expelling air from the sealed volume via the one-way outlet valve on the second glass pane; wherein the step of introducing the gas into the sealed volume comprises: opening the one-way inlet valve via gas pressure against a resilient bias of the one-way inlet valve, and wherein the step of expelling air from the sealed volume comprises opening the one way outlet valve;

and whereby the step of opening the one-way inlet valve includes: moving a valve member from a closed position, in which it prevents fluid communication from the atmosphere to the sealed volume, to an open position, in which it allows fluid communication from the atmosphere to the sealed volume.

8. The method according to claim 7, whereby the step of opening the one-way outlet valve includes:

moving a valve member from a closed position, in which it prevents fluid communication from the sealed volume to atmosphere, to an open position, in which it allows fluid communication from the sealed volume to atmosphere.

9. The method according to claim 7, whereby the step of introducing the gas into the sealed volume comprises:

opening the one-way inlet valve, by moving the valve member against a spring biasing the valve member to the closed position.

10. The method according to claim 7, whereby the step of introducing the gas into the sealed volume between the first and second glass panes via one-way inlet valve comprises:

connecting an external gas supply to the one-way inlet valve.

11. The method according to claim 8, whereby the step of expelling air from the sealed volume via the one-way outlet valve further includes:

turning a portion of the one-way outlet valve in a first direction to move the valve member from the closed position to the open position, wherein turning the portion in a direction opposite to the first direction enables the valve member to move from the open position to the closed position.

12. The method according to claim 7, whereby the step of expelling air from the sealed volume via the one-way outlet valve further comprises:

collecting contents of the sealed volume.

13. The method according to claim 7, wherein the one-way inlet valve and the one-way outlet valve are made from brass, stainless steel or an ultra-violet light stable material.

* * * * *